US009383115B2

(12) United States Patent
Siegel et al.

(10) Patent No.: US 9,383,115 B2
(45) Date of Patent: Jul. 5, 2016

(54) FRESH AIR VENTILATION PACKAGE

(75) Inventors: Moshe Michael Siegel, Piermont, NY (US); Fredric Nadel, Westport, CT (US); Qianli Fu, Fort Lee, NJ (US)

(73) Assignee: Ice Air, LLC, Mount Vernon, NY (US)

( * ) Notice: Subject to any disclaimer, the term of this patent is extended or adjusted under 35 U.S.C. 154(b) by 1307 days.

(21) Appl. No.: 12/724,975

(22) Filed: Mar. 16, 2010

(65) Prior Publication Data

US 2011/0226443 A1 Sep. 22, 2011

(51) Int. Cl.
*F24F 13/04* (2006.01)
*F24F 1/02* (2011.01)
*F24F 7/013* (2006.01)

(52) U.S. Cl.
CPC ..... *F24F 1/027* (2013.01); *F24F 7/013* (2013.01)

(58) Field of Classification Search
CPC ..... F24F 7/013
USPC ..... 454/229
See application file for complete search history.

(56) References Cited

U.S. PATENT DOCUMENTS 2,851,866 A * 9/1958 Rose ..... F24F 1/027 62/427
2,917,905 A * 12/1959 McGrath ..... F24F 1/027 62/140
3,366,169 A * 1/1968 Laing ..... F04D 17/04 165/122
3,438,219 A * 4/1969 Brugler ..... F24F 1/02 62/262
3,628,350 A * 12/1971 Ruth ..... F24F 1/02 165/127
3,659,432 A 5/1972 Selhost
3,727,424 A 4/1973 Edens et al.
3,762,182 A 10/1973 Loos et al.
3,792,593 A * 2/1974 Loos ..... F24F 1/027 62/262
3,826,105 A 7/1974 Marsteller
3,888,090 A * 6/1975 Meyer ..... B63J 2/04 62/217
3,938,348 A * 2/1976 Rickert ..... F24F 1/027 62/122
4,129,996 A 12/1978 Hardin et al.
4,142,574 A * 3/1979 Shavit ..... 165/215
4,478,053 A 10/1984 Yano et al.
4,524,588 A * 6/1985 Bond ..... 62/262
4,553,404 A 11/1985 Malchow et al.
4,553,405 A 11/1985 Napolitano et al.
4,679,494 A * 7/1987 Katayama ..... F16C 1/105 251/294
5,056,333 A * 10/1991 Cho ..... F24F 1/027 62/262
5,225,167 A * 7/1993 Wetzel ..... A61L 9/20 250/492.1
5,291,749 A * 3/1994 Schulak ..... 62/183
5,295,531 A * 3/1994 Tsunekawa et al. ..... 165/48.1
5,372,189 A * 12/1994 Tsunekawa et al. ..... 62/262
5,619,862 A 4/1997 Ruger et al.
5,743,109 A * 4/1998 Schulak ..... 62/428
5,979,169 A * 11/1999 Price ..... F24F 1/00 312/236
5,987,908 A * 11/1999 Wetzel ..... 62/259.1
6,000,234 A * 12/1999 Baek ..... 62/262
6,237,354 B1 5/2001 Cromer (Continued)

FOREIGN PATENT DOCUMENTS

JP 5096117 4/1993
WO WO 9922184 A1 * 5/1999 ..... F24F 7/013

*Primary Examiner* — Steven B McAllister
*Assistant Examiner* — Frances F Hamilton
(74) *Attorney, Agent, or Firm* — Blank Rome LLP; Peter S. Weissman

(57) ABSTRACT

The invention relates to fresh air ventilation devices adapted for use with air conditioners (ACs) and/or heaters. In operation, the device supplements the recirculating air of the AC/heater with fresh air drawn from outside of the building.

10 Claims, 6 Drawing Sheets

(56) References Cited

U.S. PATENT DOCUMENTS 6,241,600 B1 * 6/2001 Uehara ..... F24F 7/013 454/235
6,302,783 B1 10/2001 Vroege
6,336,338 B1 * 1/2002 Koren ..... F24F 1/0003 62/262
6,481,228 B1 * 11/2002 Chiang ..... F24F 1/0007 62/223
6,484,524 B1 * 11/2002 Ulanov ..... 62/263
6,497,740 B1 * 12/2002 Moretti ..... B01D 46/001 55/418
6,658,882 B2 * 12/2003 Ohama et al. ..... 62/262
7,059,536 B2 * 6/2006 Schneider et al. ..... 237/2 A
8,702,482 B2 * 4/2014 Helt et al. ..... 454/229
2002/0184909 A1 * 12/2002 Hobbs ..... F24F 13/20 62/263
2003/0042010 A1 * 3/2003 Kobayashi ..... F24F 1/027 165/122

* cited by examiner

FRESH AIR VENTILATION PACKAGE

FIELD OF THE INVENTION

The invention relates to fresh air ventilation devices adapted for use with air conditioners (ACs) and/or heaters. Particularly, the fresh air ventilation device, when in operation, draws outside air from the outside to supplement the recirculating air of the AC/heater with fresh air.

BACKGROUND OF THE INVENTION

In an AC unit, it is common to provide a main partition in the unit with the evaporator being on the room side (interior) of the partition and the condenser and compressor being on the outside. During operation, the room air is recirculated through the evaporator for cooling. In a heat pump heating unit, the operation is in reverse, i.e., the room side being the condenser and the outside being the evaporator. In certain operations, it is desirable to introduce fresh air from the outside to mix with the recirculating air. For certain specified applications, it may be necessary to provide fresh air at up to 150 cubic feet per minute (CFM). Existing units generally only provide about 50-70 CFM of fresh air, which may not meet building codes and standards.

In most prior art designs, the evaporator blower wheel brings in the fresh air through one or more openings in the main partition. These openings have been located in areas of convenience and are accordingly only marginally effective at drawing in fresh air. More specifically, in most single-motor AC units, the evaporator motor is typically mounted to the outside of the main partition and its shaft extends through a hole in the partition to the evaporator blower wheel which is enclosed in a scroll. When fresh air is desired, a vent door in the main partition is opened and a path is provided for air to flow by evaporator blower wheel suction. The incoming fresh air mixes with the recirculation air as it enters the front of the evaporator blower wheel through the recirculation air orifice. With such a configuration, the fresh air flow rate is substantially below current new building standards. Further, because the flow of fresh air through the fresh air vent is drawn by a relatively slight negative pressure created at the vent door by the evaporator blower wheel, the flow rate can be substantially influenced by other factors such as the condenser fan or by interior roomside static pressure. More specifically, if the condenser fan on the back side of the partition is on at the same time that the vent door is open, some of the air which would otherwise be drawn through the main partition as fresh air could be drawn by the condenser fan and passed through the condenser to the outside. Examples of prior AC and/or heating units having fresh air ventilation are disclosed in U.S. Pat. Nos. 4,524,588; 4,553,405; and 5,372,189; which are incorporated herein by references.

Therefore, there remains a need to improve the fresh air ventilation capacity of existing AC and/or heating units.

SUMMARY OF THE INVENTION

It is an object of the present invention to provide a fresh air ventilation device for providing fresh air to an air conditioning (AC) or heating unit. The device contains an independent fan for supplementing the blower(s) of the unit with fresh air. The device is designed for effectively moving air from the exterior of the unit to the interior to help condition the space.

Another object of the present invention is to provide a ventilation assembly containing a duct and a ventilation device. The ventilation assembly mounts on the AC or heating unit and contains a fan, and a duct extending from the exterior side of the unit, through the internal partition within the unit and to the self-contained indoor fan. The fan, when activated, blows the outside air into the room side of the unit, which is then mixed with the recirculating room air that is being blown through the unit.

It is a further object of the present invention to provide an AC or heating unit with a vent assembly for allowing outdoor ambient air to enter the indoor section of the unit. Preferably, the ventilation unit is mounted on the outside of the unit and provides an air intake that is independent of the unit's evaporator or condenser blower.

A still further object of the present invention is to provide an apparatus which is economical to manufacture and maintain, simple in construction, easy to operate and compact in size and number of parts.

Other objects of the present invention will be apparent from the following Description of the Preferred Embodiments and from the appended claims.

The preceding objects are achieved according to the preferred embodiment of the invention by the provision of an AC/heating unit which is divided by a partition into an indoor section and an outdoor section. The indoor section includes an indoor heat exchanger and means for circulating air within the space to be conditioned and the indoor section. The outdoor section includes an outdoor heat exchanger and means for circulating outdoor air through the outdoor section. The indoor section includes a fresh air ventilation device containing a fan for blowing fresh air into the indoor section. The intake of the device is connected to a duct that connects the device to a fresh air source, such as the exterior or the building or the outdoor section of the unit. The exhaust of the device is opened to the indoor section of the unit. In an embodiment, the fresh air ventilation device is mounted on the outside wall of the AC/heating unit through an opening in the indoor section of the unit. The duct connects to the device through the opening; and the device blows fresh air into the indoor section through the opening.

DETAILED DESCRIPTION OF THE PREFERRED EMBODIMENTS

Figure 1:
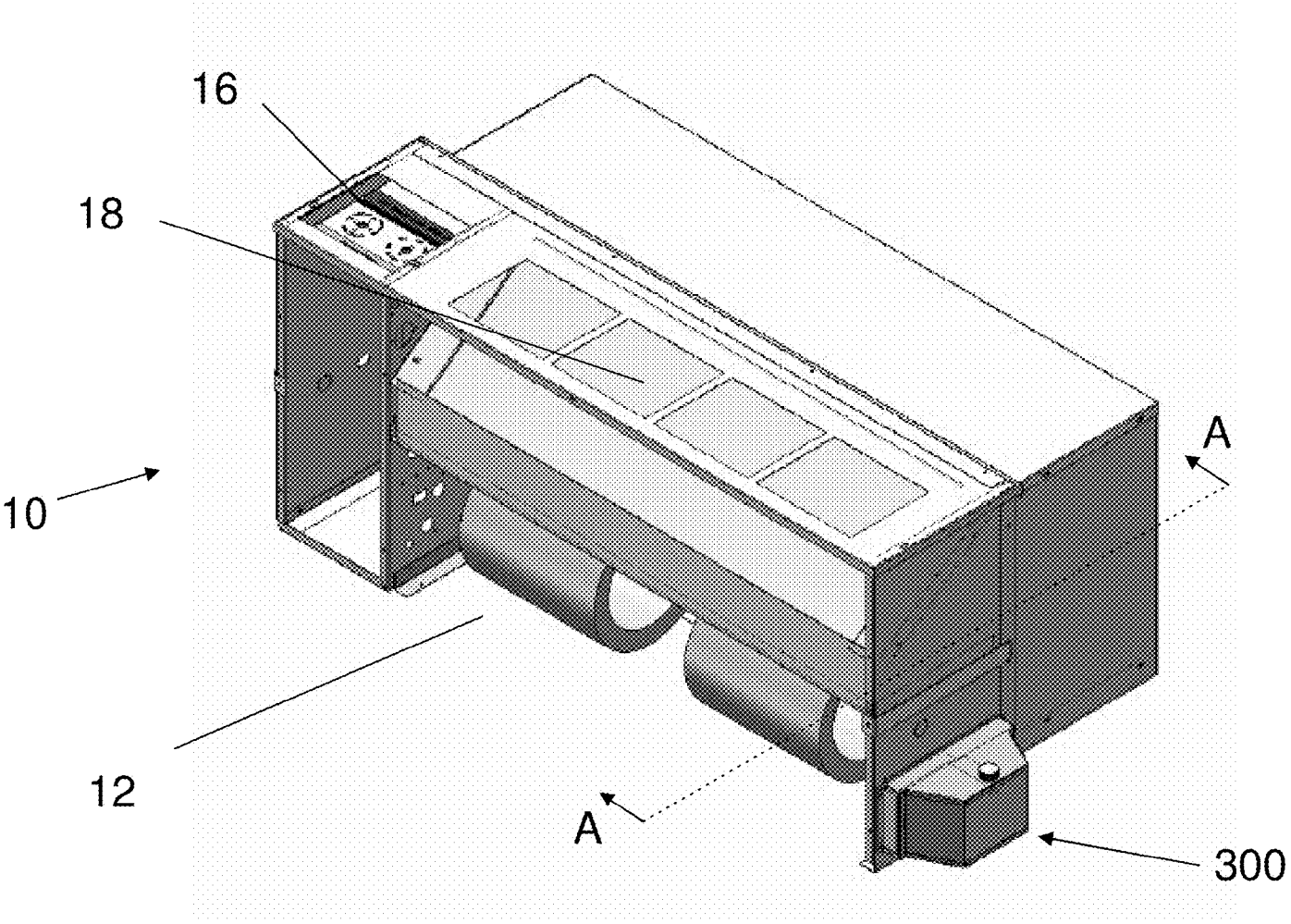
FIG. 1 shows an AC unit with the front cover removed.

Referring to FIG. 1, there is shown an AC/heating unit 10 using the invention to advantage. Although the unit 10 is shown as a combination AC and heater unit which is mounted through a wall or window opening, it is understood that the inventive principle is applicable to other types of units, such as AC only, heater only, heat pump units and units which are not mounted in a wall or window opening. The air conditioner 10 can be controlled by accessing the control panel 16. Additionally, the unit may be controlled by a variety of control mechanisms, including remotely mounted thermostatic controllers, handheld remote controllers or other means. In operation, recirculating air is drawn from the room through the front and/or the underside 12 and expelled back into the room through the exhaust 18 located at the front top.

Figure 2:
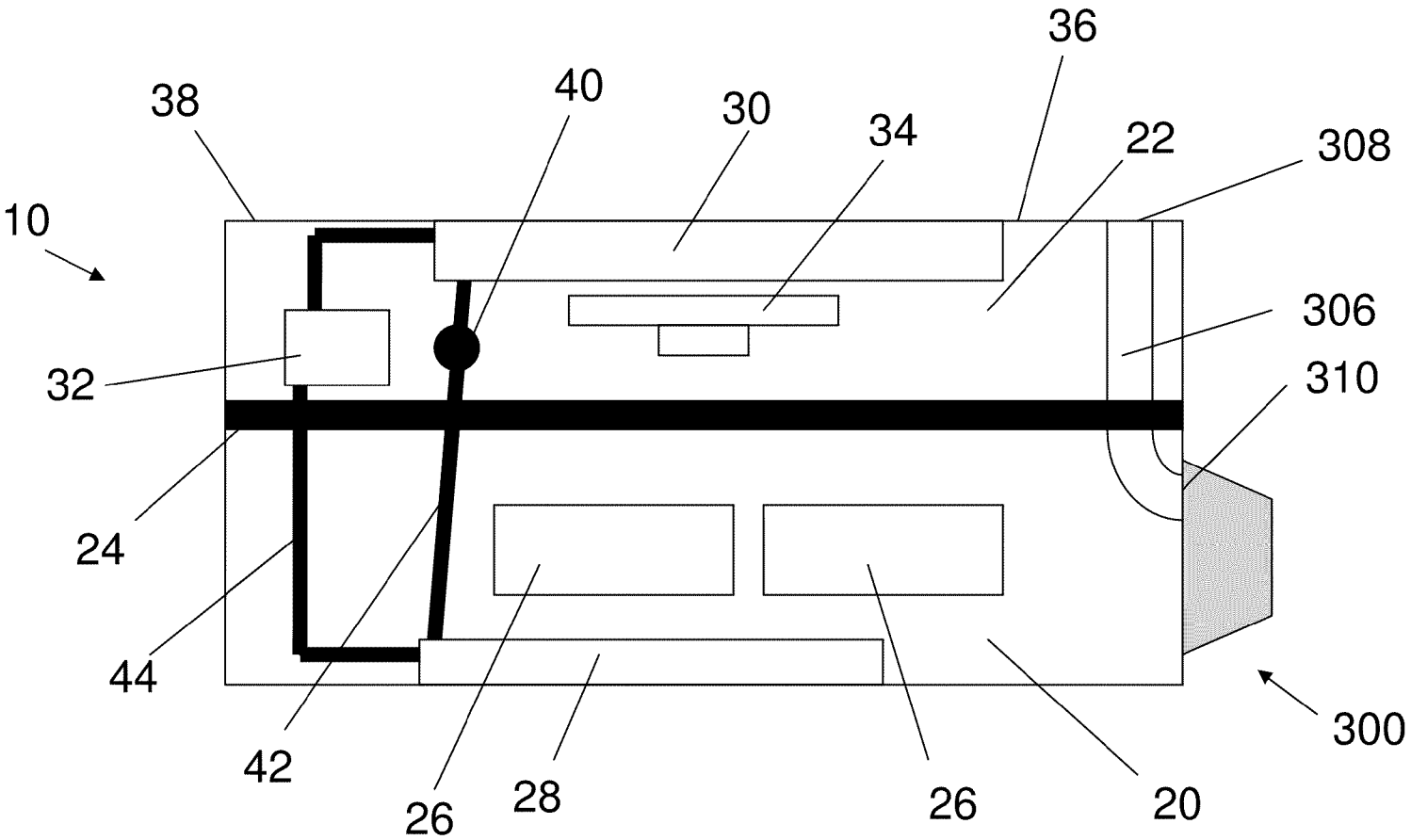
FIG. 2 shows a top cut away view of the AC unit 10 taken along line A-A of FIG. 1.

Referring to FIG. 2, there is shown a top cut away view of the AC unit 10 taken along line A-A of FIG. 1. As is conventional, the unit 10 is generally divided into an indoor section 20 and an outdoor section 22 by a main bulkhead 24. The bulkhead 24 functions as a barrier to prevent noise and outside air from entering the room to be cooled. In one mode of operation, air is prevented from flowing from the outdoor section 22 to the indoor section 20 such that all of the air being cooled is recirculation air from the room. A blower 26, when activated, draws air from the room through the front underside 12, directs the air through an evaporator 28, and expels it through the exhaust 18. The air is cooled as it passes through the evaporator 28 before being expelled through the exhaust.

The heat exchange transfer between the evaporator 28 and the condenser 30 is conventional. More specifically, a working fluid commonly referred to as a refrigerant goes through a thermal dynamic cycle. The refrigerant leaves the compressor 32 as a vapor at an elevated pressure and then condenses in the condenser 30, resulting in the transfer of heat to the condenser 30. This heat is removed by using a condenser fan 34 to pass air across the tubes and fins (not shown) of the condenser 30 for exit to the outside through the rear louvered wall 36 of the outside section 22. The side 38 of rear louvered wall 36 also communicates with the outside, so that fresh air is drawn through the condenser 30 by the condenser fan 34.

The high pressure refrigerant liquid passes from the condenser 30 through an expansion valve or capillary tube 40 where some of the refrigerant liquid flashes into vapor. The remaining fluid passes through a conduit 42 to the evaporator 28 where it vaporizes as a result of the relatively low pressure therein. The heat to support the vaporization is transferred from the air that is directed through the evaporator 28 by the blower 26. The closed loop is completed by a conduit 44 that connects the relatively low pressure evaporator 28 to the compressor 32. Both of the conduits 42 and 44 pass through small openings in the bulkhead 24. Those skilled in the art will recognize that the AC unit 10 as described can be made to function as a heater by providing components that reverse the direction of flow of the refrigerant so that the functions of the condenser 30 and evaporator 28 are reversed. Accordingly, warm air would be blown into the room and the cooler air would be exhausted to the outside. The invention, however, as described in detail hereinafter, has particular advantage for operation as an air conditioner or heater. Henceforth, reference numeral 10 refers to an AC or heating unit.

Figure 3:
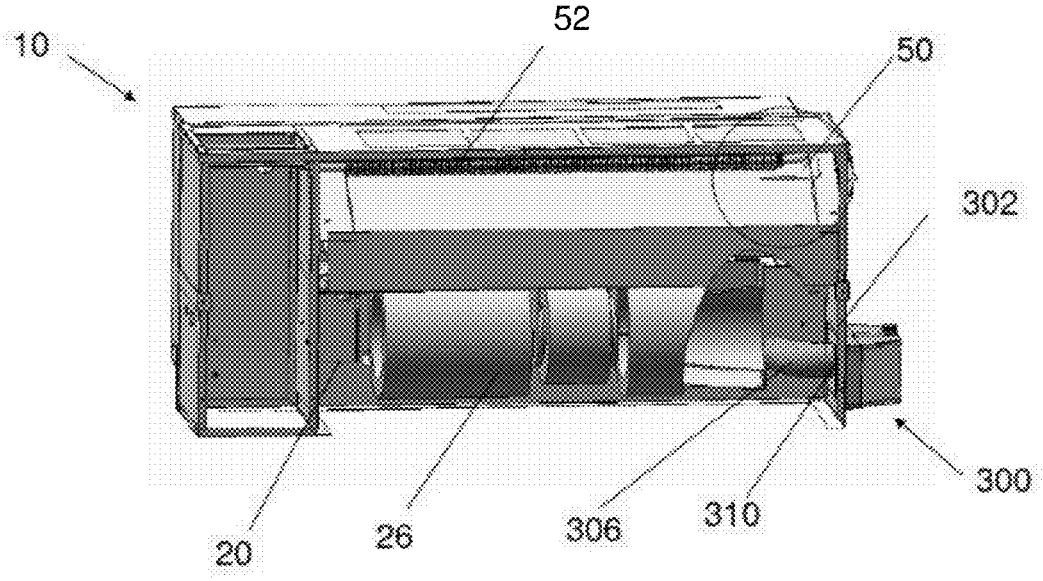
FIG. 3 shows a front view of the AC unit.

Referring to FIGS. 1-3, in accordance with the present invention, a fresh air ventilation device 300 is provided with the unit 10. In the illustrated embodiments, the device 300 is attached on the exterior of the unit 10 and is exposed to the indoor section 20 of the unit 10 through an opening 302 in a side wall of the unit 10. The device 300 contains a fan 304 (shown in FIGS. 4-5) for blowing fresh air into the indoor section 20. The intake side of the fan 304 is connected to the outside of the unit 10 by a duct 306. The duct 306 is attached on a first end 310 to the intake side of the fan 304. The second end 308 of the duct 306 is connected to the outside of the unit 10. The duct 306 is preferably routed through the main bulkhead 24 though an opening just large enough to allow the duct 306 to pass therethrough without compromising the integrity of the bulkhead 24. The fresh air ventilation device 300 is attached to the side wall of the AC/heating unit 10 using fasteners, such as screws or bolts.

As further illustrated by FIGS. 1 and 2, the device 300 is positioned at the bottom of the front end of the unit 10. In that location, the device 300 is inside the room and is accessible to the user for operation. In addition, the device 300 can be easily mounted to existing AC/heater units 10. However, it should be appreciated that the device 300 can be configured to be mounted to other suitable locations of an AC/heater unit 10, within the scope of the invention.

Figure 4:
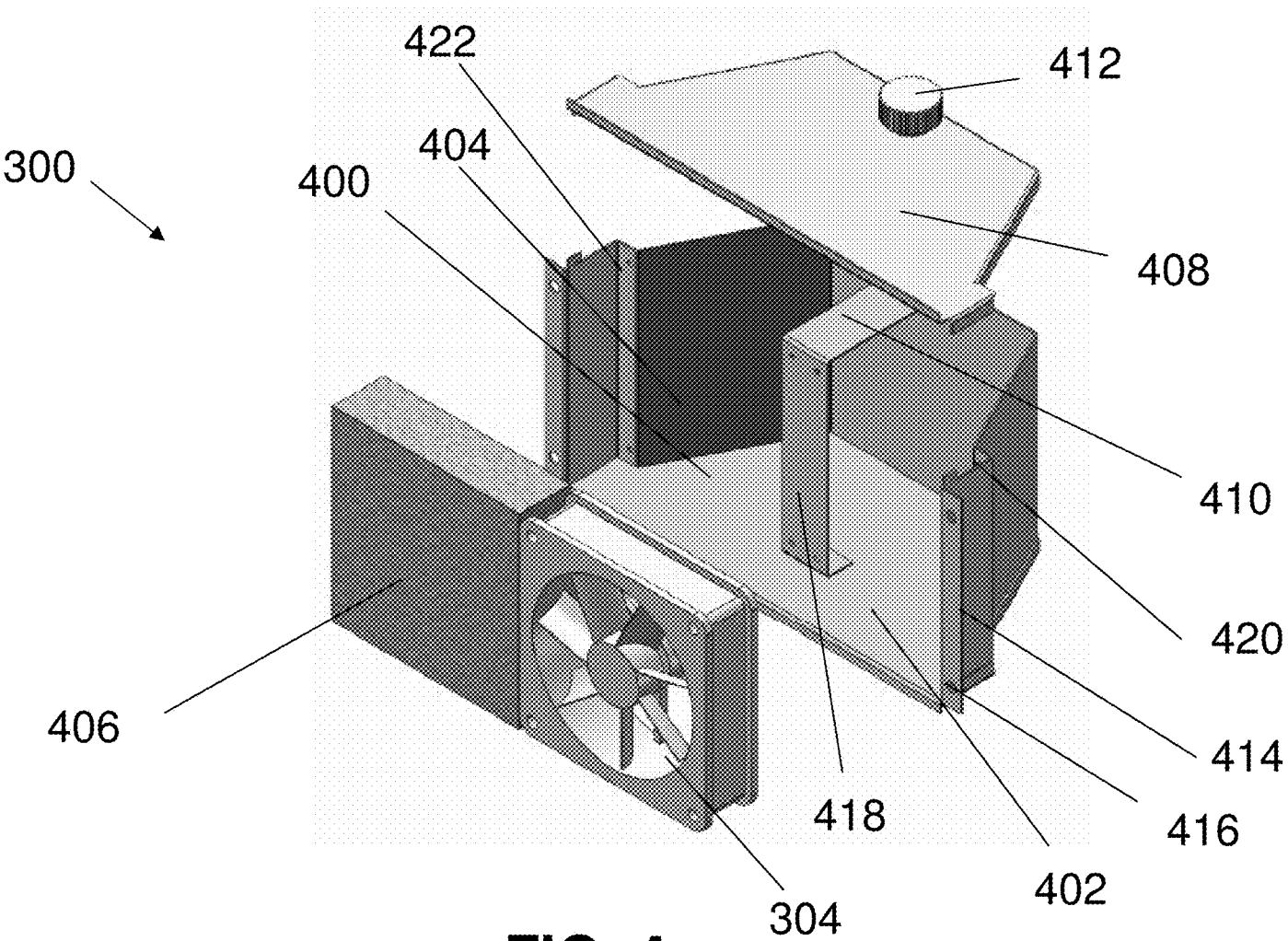
FIG. 4 shows the parts of the fresh air ventilation device.
Figure 5:
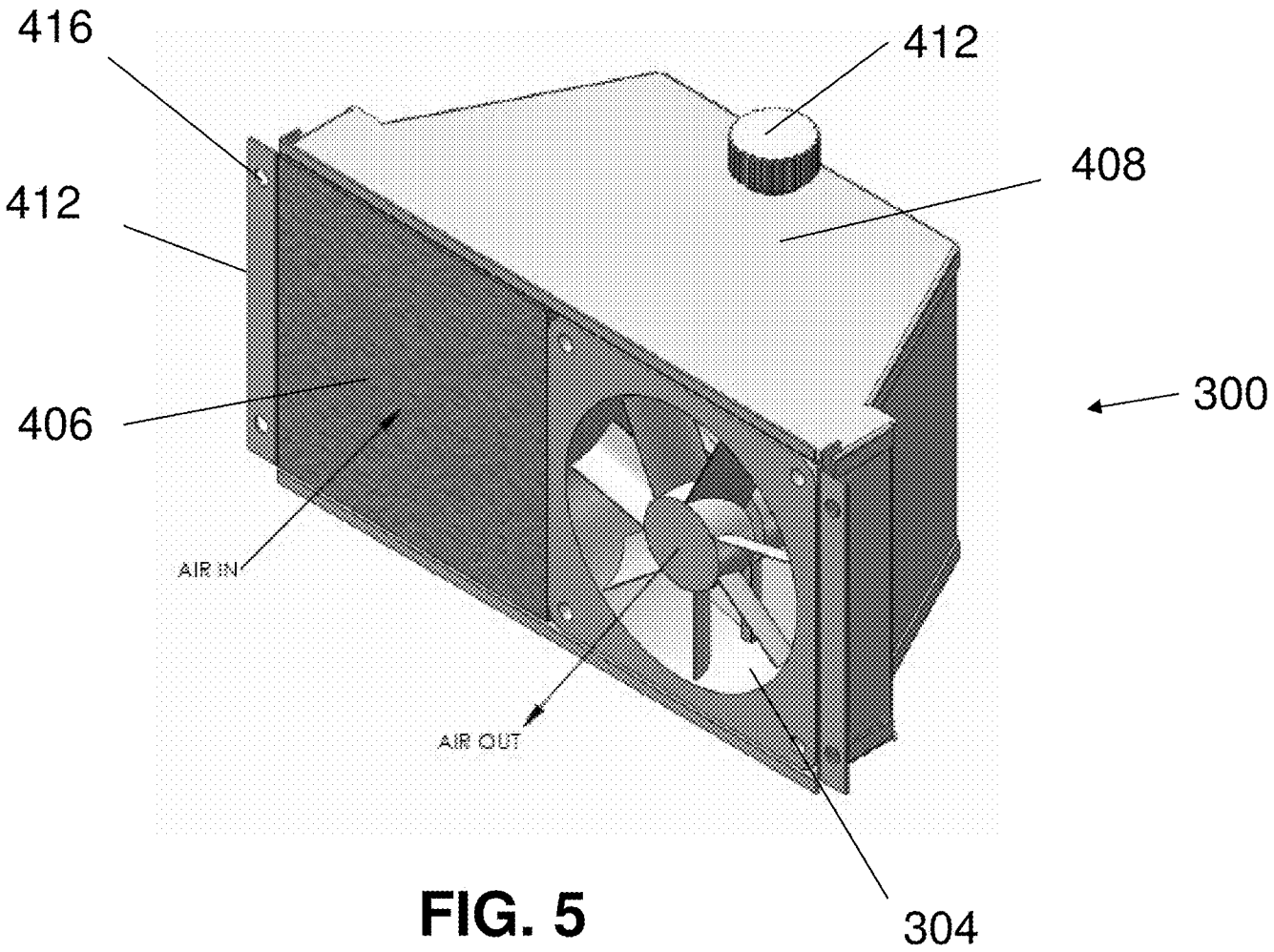
FIG. 5 shows the assembled fresh air ventilation device.
Figure 6:
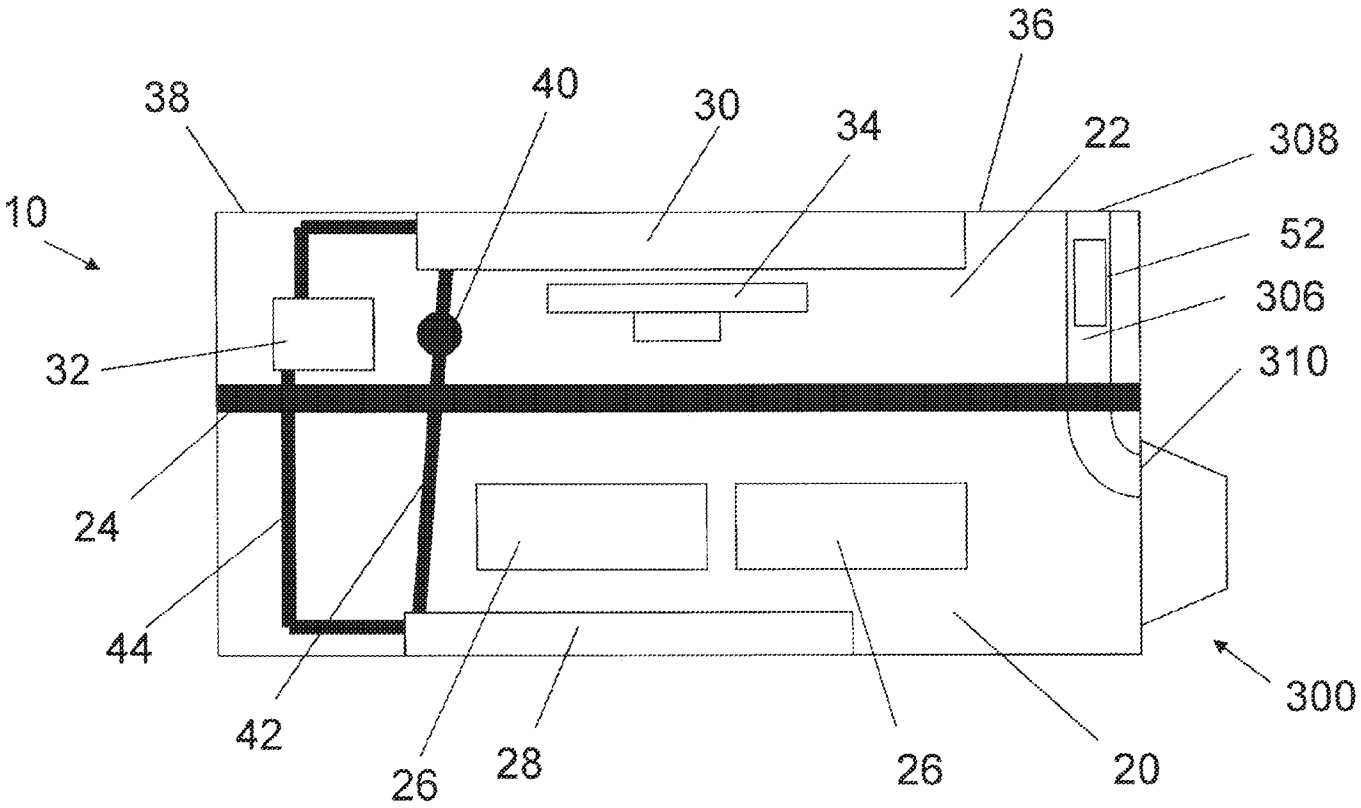
FIG. 6 shows the unit having a heater for preheating the air.

Referring to FIGS. 4-5, a preferred embodiment of the device 300 is depicted. In this embodiment, the device 300 is essentially an enclosed container mounted on the unit 10 such that an operating side 400 of the container is mounted flush against the opening 302. The operating side 400 has an opened face that is divided into two portions. The first (expel) portion 402 contains the fan 304; and the second (input) portion 404 is attached to the duct 306. In a preferred embodiment, the second portion 404 contains a filter 406 for filtering the fresh air before it is propelled into the indoor section 20. In this embodiment, the top side 408 of the device is removable to allow the filter 406 to be changed or cleaned. As illustrated in FIG. 4, the top side 408 is preferably screwed to a support member 410 with a knobbed screw 412, which allows for quick and easy access to the filter 406. The support member 410 has an upright section 418 which separates the input portion 404 from the expel portion 402. The fan 304 is mounted within a receiving flange 420 at the end of the expel section 402 and is screwed to the upright section. Likewise, the filter 406 is received in a receiving flange 422 at the input section 404 of the device housing, and is set within the upright section of the support member 410. The top section of the support member 410 is substantially perpendicular to the upright section 418, and extends across the top of the device 300.

With the top 408 in place, the housing of the device 300 operates as a plenum. The fan 304 pulls fresh air though the duct 306 from the outside of the unit 10. The fresh air enters the plenum at the input portion 404. The air passes through the filter 406, through the plenum and out the expel portion 402 of the device 300. The fan 304 propels the fresh air across the input side of the blower 26. The blower 26 effectively mixes the fresh air it receives from the fan 304 with the room air it pulls in from the room, and forces that mixture across the evaporator 28 and into the room. That provides the desired increased amount of fresh air into the mixture which is cooled by the unit 10. Although this arrangement is preferred, it should be apparent to one skilled in the art that other methods for removably attaching the top side 408 to the device 300 can be adapted for use with the present invention. The operating side 400 may contain flanges 414 having holes 416 therein to attach the device 300 to the AC/heating unit 10.

The fan 304 of the device 300 is electrically connected to the unit fan controller and is designed to run whenever the unit indoor fan is operating. In another embodiment, a controller for controlling the speed of the fan (e.g., high, medium, low), and thus, the amount of fresh air being introduced into the indoor section 20 is connected to the apparatus. This allows a user, e.g. by turning a control knob on the controller, to adjust the amount of fresh air entering the room. In certain embodiments, the controller can be used to activate the fan 304 at certain times of the day by presetting the controller. It may also be possible to automatically activate the fan 304 based on the oxygen level in the room. In this embodiment, an oxygen sensor is placed in the room and is connected to the controller electrically or wirelessly. When the oxygen sensor drops below a preset level, the fan 304 is activated to draw fresh air into the indoor section 20 of the unit 10. In another alternative embodiment of the invention, the device 300 can be configured to be automatically operated whenever the AC/heater unit 10 is operated, to provide a desired mixture of fresh air to recirculated room air.

In an additional embodiment, when the unit 10 is being utilized as a heater, it may be necessary to pre-heat the fresh air entering the unit 10 to prevent freezing of the unit 10 or freezing of other interior fixtures. In particular, ancillary hot water heating apparatus and/or room plumbing fixtures (e.g. evaporator 28, condenser 30, blowers 26, etc.) and piping (e.g. conduits 42 and 44, etc.) can freeze or crack if the fresh air is too cold. Thus, this is especially desirable for use with heaters where the fresh air entering the unit 10 can be significantly below the freezing temperature. In the embodiment of FIG. 3, a thermostat 50 is installed in the indoor section 20 of the unit 10. As shown, the thermostat 50 is preferably located within the airstream from the indoor unit air. If the temperature drops below a set point, the thermostat activates a heating system 52 to preheat the fresh air before it enters the indoor section 20. In the embodiment shown, an electric heater 52 can be located inside the unit 10 to heat the fresh air as it passes through the unit.

When the AC/heating unit 10 containing the fresh air ventilation device 300 is in use, the user can manually activate the device 300 manually or automatically. When activated, the device 300 draws air from the fresh air source and injects it into the indoor section 20 of the unit 10. This allows the blower 26 to mix the fresh air with the recirculating air and improves the quality of the air exiting the AC/heating unit 10.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An air conditioning (AC) or heating assembly comprising:

an AC or heating unit having an indoor section, an outdoor section, and a main bulkhead separating the indoor section from the outdoor section, said unit having an external housing surrounding the indoor section and the outdoor section; and a fresh air ventilation assembly comprising:

a fan, a plenum defined by a plenum housing and a duct, the plenum housing containing the fan and having an intake end, the duct having:

a first end directly connected to an outer surface of the outdoor portion of the external housing to receive fresh outside air from outside of the unit, and a second end directly connected to the intake end of the plenum housing, wherein the plenum is opened to the indoor section to inject the fresh outside air to the indoor section, thereby mixing the fresh outside air with recirculating air; and wherein the plenum housing is mounted on an outer surface of the indoor portion of the external housing.

2. The AC or heating assembly of claim 1, wherein the duct extends through an opening in the bulkhead to connect to the fresh outside air.

3. The AC or heating assembly of claim 2, wherein the fan pulls the fresh outside air through the duct and exhausts the fresh outside air into the indoor section.

4. The AC or heating assembly of claim 1, wherein the flesh air ventilation assembly further comprises a filter for filtering the fresh outside air.

5. The AC or heating assembly of claim 1, further comprising a controller for controlling the operation of the fresh air ventilation assembly.

6. The AC or heating assembly of claim 5, wherein the controller is a timed controller, a temperature controller, an oxygen level controller, or a fan speed controller.

7. The AC or heating assembly of claim 1, further comprising a heater for preheating the fresh outside air.

8. The AC or heating assembly of claim 1, further comprising a thermostat for sensing the temperature of the fresh outside air and/or the mixed fresh outside air and the recirculated air.

9. The AC or heating assembly of claim 1, wherein said plenum is mounted to an outside of the AC or heating unit.

10. The AC or heating assembly of claim 1, wherein said AC or heating unit has a housing with an opening and said plenum is mounted to an outside of the housing about the opening.

* * * * *